United States Patent [19]

Conforti et al.

[11] Patent Number: 5,046,237

[45] Date of Patent: Sep. 10, 1991

[54] EXTRACTOR TOOL

[75] Inventors: Carl J. Conforti, Fall River; Walter L. Walas, Rehoboth; John G. Spadaro, North Attleboro, all of Mass.

[73] Assignee: Texas Instruments Incorporated, Dallas, Tex.

[21] Appl. No.: 570,471

[22] Filed: Aug. 21, 1990

[51] Int. Cl.[5] ..... H01R 43/00

[52] U.S. Cl. ..... 29/764; 29/278; 29/758

[58] Field of Search ..... 29/764, 235, 758, 278, 29/762

[56] References Cited

U.S. PATENT DOCUMENTS

| | | | |
|---|---|---|---|
| 3,951,514 | 4/1976 | Medina, Jr. | 29/764 X |
| 4,425,704 | 1/1984 | Cline | 29/764 |
| 4,873,761 | 10/1989 | Kotsunsky et al. | 29/741 |

*Primary Examiner*—Carl E. Hall

*Attorney, Agent, or Firm*—James P. McAndrews; John A. Haug; Melvin Sharp

[57] ABSTRACT

An extractor tool for removing a circuit module from a connector where the module has a substantial length, has a plurality of electrical contacts resiliently engaged with corresponding connector contacts, and has latch means at opposite ends receiving engagement by separate connector latches for detachably retaining the module on the connector. The tool has a thin flat body with spaced parallel legs extending from one side of the body to accommodate the substantial module length between the legs and has tapered surfaces on the edges of the distal ends of the legs to be pressed against the separate connector latches to release both of the latches at the same time to permit removal of the module from the connector free of damage to the latches or the resiliently engaged contacts.

7 Claims, 2 Drawing Sheets

EXTRACTOR TOOL

BACKGROUND OF THE INVENTION

The invention relates to connectors used for mounting circuit memory modules or the like on printed circuit boards and relates more particularly to an extractor tool for removing the modules from the connector with minimal risk of damage to the modules and connector contacts.

A number of connector devices are presently being used for receiving circuit memory modules of substantial length wherein one edge of the module is inserted into the connector and the module is then rotated around an axis extending along the length of the module to bring module contacts into firm, wiping, electrical engagement with connector contacts. Such connectors permit a large amount of memory to be detachably connected into a printed circuit on a board mounting the connector and sometimes the connectors mount a plurality of the memory modules to further increase memory capacity. In that type of mounting for memory modules, commonly called SIMM modules e.g., each module is typically of sufficient length to be subject to some warpage and to be subject to substantial twisting force intermediate the module ends if force is applied to one end of the module to remove it from the connector while module contacts at the other end of the module are still engaged with connector contacts. Typically such modules have latch means provided thereon adjacent respective opposite ends of the module to receive engagement by separate connector latches to assure that both ends of the module are properly seated in the connector when the latches are engaged, thereby to prevent rotation of the module to detach it from the connector. When such modules are to be removed from the connectors, it is found that releasing of the separate latches at opposite ends of the module tends to result in twisting forces being applied to the module as the latches are separately released with the result that a significant amount of damage to the modules or to connector latches or contacts is experienced in removing modules from the connector. It would be desirable if such damage could be avoided while still permitting continued use of the otherwise reliable and inexpensive module mounting and latching arrangements as above described which are tending to become somewhat standardized in connector and module products of different manufacturers.

BRIEF SUMMARY OF THE INVENTION

It is an object of the invention to provide a novel and improved means for removing circuit memory modules and the like from connectors mounted on printed circuit boards where such modules have substantial length and are latched to the connector by separate connector latches at opposite ends of the module; to provide an extractor tool for removing such memory modules from circuit board connectors with minimal risk of module damage or damage to connector latches or contacts; to provide such a tool which facilitates removal of modules from single and multiple module connectors; and to provide such an extractor tool which is of low cost and which is convenient to use.

Briefly described, the novel and improved extractor tool of the invention comprises a thin, rigid, substantially flat body of an electrical insulating material such as glass-filled nylon which extends generally in a plane and has a pair of integral legs extending in the plane from one side of the body at respective opposite ends of the body. The legs extend in spaced, generally parallel relation to each other to accommodate the substantial length of a circuit memory module or the like between the legs, and the module is mounted on a connector and holds a plurality of module contacts in resilient electrical engagement with corresponding connector contacts. Distal ends the legs have respective tapered edge surfaces which face away from each other in directions away from the ends of the body to be conveniently engaged with separate resilient connector latches at both ends of the circuit module at the same time, thereby to permit the tool to be pressed against the latches for springing the latches apart to release the module and permit removal of the module from the connector. Preferably a portion of the distal end of each leg is cut back from the tapered surface along the inner, facing edges of the legs to form stops for engaging corresponding surfaces of the connector to prevent excessive movement of the tool relative to the connector such as might overstress and break the connector latches. Preferably wedge-shaped, tapered surface portions are provided on flat sides of the body adjacent the distal ends of the legs to stand up from the general plane of the body to be wedged against the module, or between the module and the connector, to move the circuit modules relative to the connector to disengage the module and connector contacts as the tool is pressed against the connector for releasing the connector latches. In that way, the tool permits convenient removal of modules from the connectors while avoiding risk of damage to the module and connector latches or contacts such as might otherwise result from attempting to remove one end of the module before the opposite end of the module is released by a connector latch.

DESCRIPTION OF THE DRAWINGS

Other objects, advantages and details of the novel and improved tool of the invention appear in the following detailed description of preferred embodiments of the invention, the detailed description referring to the drawings in which.

DESCRIPTION OF THE PREFERRED EMBODIMENTS

Figure 1:
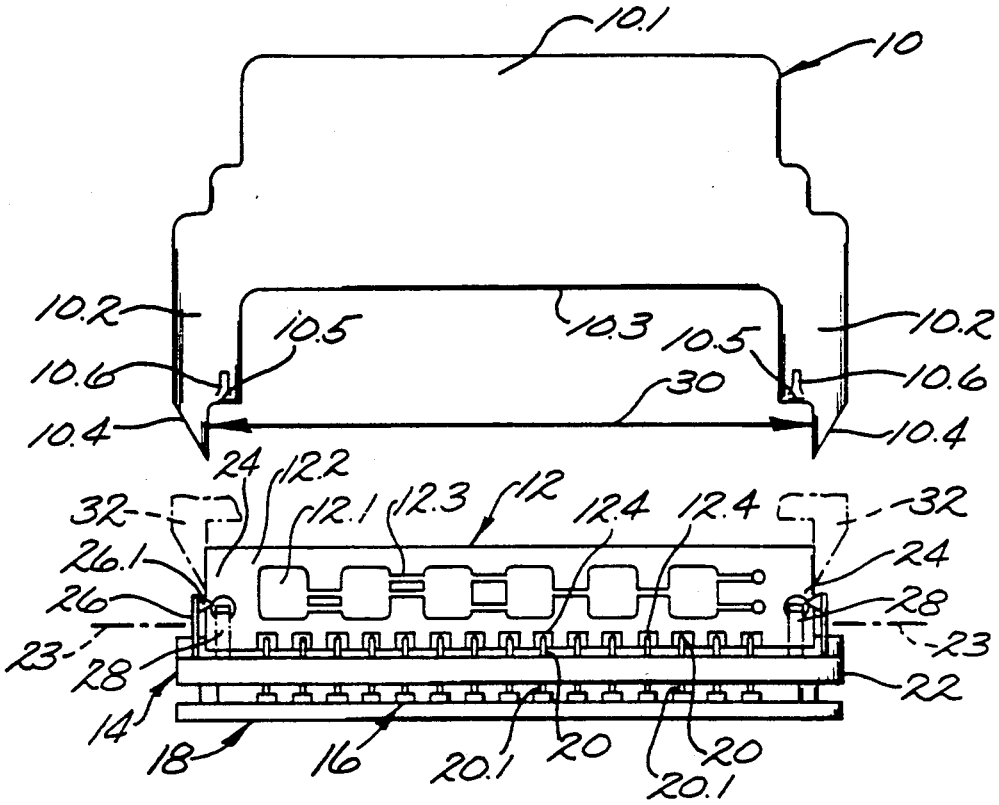
FIG. 1 is a front elevation view of the novel extractor tool of the invention illustrating use of the tool.
Figure 2:
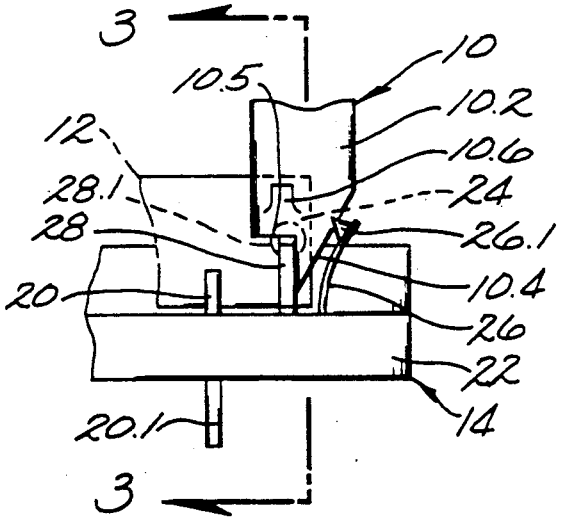
FIG. 2 is a partial view similar to FIG. 1 to enlarged scale illustrating use of the tool.
Figure 3:
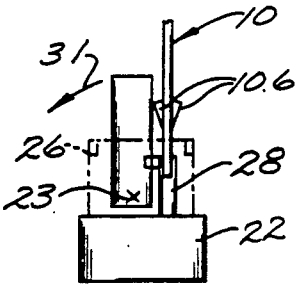
FIG. 3 is a partial section view along line 3—3 of FIG. 2.

Referring to the drawings, 10 in FIGS. 1-3 indicates the novel extractor tool of the invention which is shown being used for removing a circuit memory module 12 of the type commonly called a SIMM module from a connector 14 of a type conventionally used for detachably mounting the memory module and connecting the module circuit with a larger circuit indicated at 16 on a printed circuit board 18 or the like. Typically as indicated, the connector 14 has a plurality of generally C-shaped electrical contact members 20 which have post parts 20.1 extending through apertures (not shown) in a connector housing 22 into corresponding apertures (not shown) in the circuit board, the contact posts 20.1 being soldered or otherwise electrically connected to appropriate portions of the circuit 16 as will be understood. The circuit memory module 12 typically comprises a plurality of integrated circuit memory units 12.1 which are mounted on a module circuit board 12.2 by inserting unit contacts (not shown) into corresponding apertures (not shown) in the module circuit board 12.2 and by soldering or otherwise electrically connecting the unit contacts to module circuit board circuit paths diagrammatically indicated at 12.3. The module circuit terminates in a plurality of contacts 12.4 located along an edge of a module circuit board. Typically circuit module 12 is mounted on the connector 14 with the module contacts 12.4 resiliently engaged with respective connector contacts 20 by inserting an edge of the module circuit board into the open end of the C-shape provided in each connector contact and by rotating the module around an axis (indicated at 23 in FIGS. 1 and 3) extending along the length of the module for moving the module contacts into wiping electrical engagement with an end of the C in the C-shape. The module has latch means indicated at 24, such as an edge portion of the module, at each of two opposite ends of the module which receive latching engagement from separate latches 26 provided on the connector housing for detachably retaining the module on the connector with the module and connector contacts resiliently connected to each other. Typically, for example, the latches are molded integral with the connector housing to have spring characteristics and the latches have a tapered surface 26.1 facing toward the module 12 as the module is rotated toward the latches to be pressed aside by engagement with the module and to snap into the position shown in FIG. 1 to detachably retain the module on the connector against bias applied to the module by the C-shaped contacts as shown in FIG. 1. Preferably the connector housing has integral alignment fingers 28 or the like adapted to mate with openings 28.1 in the circuit module for aligning the module and circuit along the axis 23 to engage the respective module and connector contacts. As the connector and circuit module are conventional they are not further described herein and it will be understood that the circuit module has a substantial length such that, where the module circuit board is subject to any warpage or the like, the separate latches serve to assure that both ends of the module are properly positioned in the connector to engage all module and connector contacts with each other.

In accordance with the invention, the tool 10 is formed by molding or blanking or the like from a suitably strong, rigid, electrical insulating material such as glass-filled nylon or the like, the material preferably being selected to avoid development of static electricity on the body. The body is formed with a thin, generally flat portion 10.1 disposed in a plane having a pair of legs 10.2 extending in generally parallel relation to each other in the plane from one side 10.3 of the body, the legs having a selected spacing as indicated at 30 therebetween to accommodate the substantial length of the circuit module between the legs. The distal ends of the legs have respective tapered edge surfaces 10.4 which face in substantially opposite directions from each other so that each tapered edge surface faces away from said one body side and in a direction away from one end of the body. Preferably a portion of each leg is cut away adjacent the distal end of the leg along inner facing edges of the respective legs to form stops 10.5 on the legs. Preferably, wedge-shaped body portions 10.6 are also provided on the tool body, preferably integral with the body or attached to the body by heat-fusing or the like, to provide additional tapered surfaces standing up from each of the opposite flat sides of the body adjacent the distal ends of the body legs with the tapered surfaces of the wedged-shapes facing out from the legs and toward the distal leg ends.

In that arrangement, the body is adapted to be positioned as shown in solid lines in FIG. 1 adjacent the module 12 and is then moved to engage the tapered leg edges 10.4 with both of the separate latches 26 at the same time as indicated with open broken lines 32 in FIG. 1. The tool is then pressed against the latches to separate or spring the latches apart as illustrated in FIG. 2, thereby to release engagement of the latches from the respective latch means 24 on the module to permit removal of the module 12 from the connector 14. That is, with both of the latches 26 released at the same time, the module 12 is easily rotated around the axis 23 as indicated by the arrow 31 in FIG. 3 to disengage the module and connector contacts without damage to them and to permit module removal. Preferably, the stops 10.5 at the distal ends of the tool legs are located and proportioned to engage corresponding stop surfaces on the connector 14, such as the tops of the spring alignment fingers 28 for example, to limit movement of the tool against the latches to avoid overstressing and breaking of the latches. Preferably also the wedge-shaped portions of the body legs are located and proportioned to bear against the circuit module 12 at the respective opposite ends of the module as shown in FIG. 3 as the tool is pressed for releasing the latches 26, thereby to tend to rotate the modules around its axis 23 to release the resilient engagement of the plurality of module and connector contacts with reduced risk of damage to the module connector contacts. In that arrangement, the tool is easily inserted into a desired location on a circuit panel for releasing a circuit module from a connector. The tool is adapted to be conveniently used where several modules may be mounted in closely stacked relation in a common connector or in closely spaced relation to an adjacent connector. The tool is not electrically conductive and has properties selected to reduce the development of electrostatic electricity on the tool so there is no risk of creating an electrical short in a module circuit or the like through use of the tool.

Figure 4:
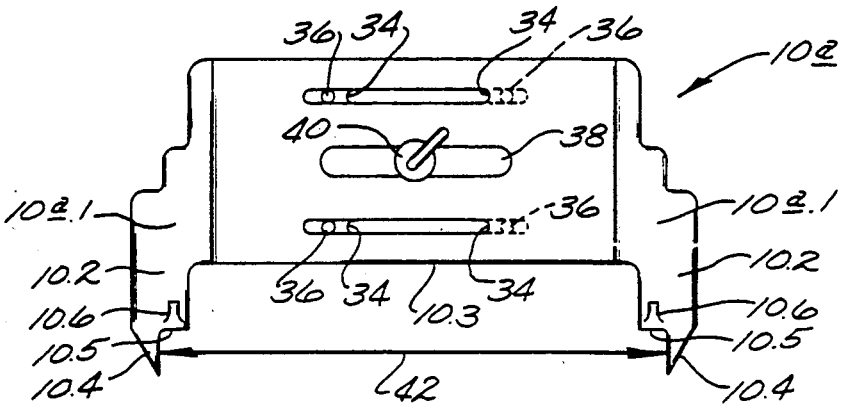
FIG. 4 is a front elevation view similar to FIG. 1 illustrating an alternate embodiment of the invention.

In an alternate embodiment of the invention as illustrated in FIG. 4, a tool **10*a* is divided into two portions 10*a*.1, 10*a*.2 having mating slots 34 and bosses 36 and each having an additional mating slot 38 receiving and holding and adjustable clamp of any conventional type such as a screw clamp 40 having two halves (only one being shown) which are threadedly engaged through the slot 38 to clamp or hold the body halves together with any desired spacing 42** within a range between the legs of the body. In that arrangement, the body is adapted to be used with circuit modules of different lengths as desired.

Figure 5:
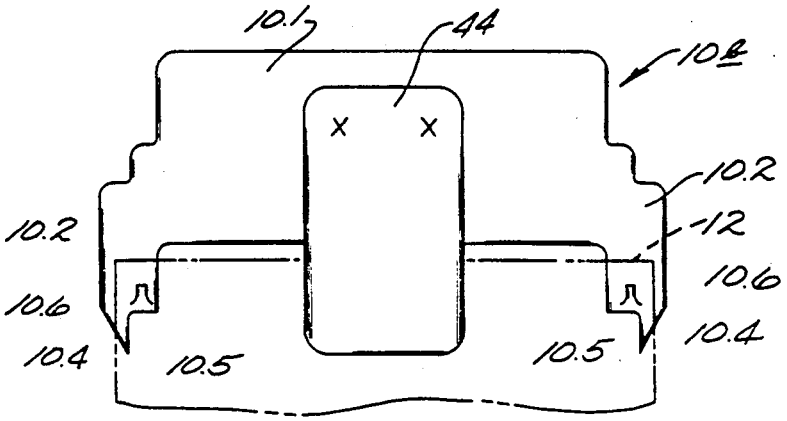
FIG. 5 is a front elevation view similar to FIG. 1 of an alternate embodiment of the invention.

In another alternate embodiment of the invention as shown in FIG. 5, a tool **10*b* has a pair of flexible fingers 44** (only one being shown) attached at one end to respective opposite sides of the tool body so that, when the tapered surfaces on the tool legs are engaged with connector latches to release the latches as above described, the opposite ends of the flexible fingers are disposed at respective opposite sides of the module. Accordingly, the operator of the tool is able to press the flexible fingers together in his hand as the tool is used to grasp the module between the flexible fingers to aid in removing the module in a convenient manner.

It should be understood that although particular embodiments of the tool of this invention are described by way of illustrating the invention, the invention includes modifications and equivalents of the tool falling within the scope of the appended claims:

We claim:

1. A tool for removing a circuit module from an electrical connector where the module is of substantial length and has latch means at opposite ends receiving engagement from separate latches on the connector for detachably retaining the module on the connector with a plurality of electrical module contacts resiliently engaged with respective electrical connector contacts comprising a body having a pair of legs with selected spacing therebetween extending in generally parallel relation to each other from one side of the body adjacent respective opposite ends of the body to be engaged with respective latches adjacent the module latch means, the legs having respective tapered portions at distal ends thereof to intercept and be pressed against respective connector latches by movement of the tool to release engagement with both the module latch means at the same time for permitting separation of the resiliently engaged contacts and removal of the module from the connector free of damage to the module, latches and contacts, the tapered portions of the body legs having tapered surfaces facing generally outward from respective opposite ends of the body, and the legs having a selected spacing to fit over and accommodate the length of the module between the legs to permit the tapered legs surfaces to press apart connector latches which are biased toward each other to engage latch means disposed on opposite ends of the module facing outward from the respective module ends, the body having wedge-shaped surfaces provided thereon adjacent the distal ends of the legs facing generally outward from respective flat opposite sides of the body to engage and press against the module for rotating the module in separating the module and connector contacts.

2. A tool according to claim 1 wherein the body has a thin, substantially flat sheet portion extending in a plane and has the body legs integral therewith to extend in that plane, the body comprising a rigid, electrically insulating material having low electrostatic development properties for permitting removal of the module from an electrical circuit including the connector contacts with minimal risk of electrical damage to the module during use of the tool for module removal.

3. A tool according to claim 2 wherein each body leg has a stop surface adjacent said distal leg end facing outwardly from said one side of the body to engage the connector after separating of the latches releases latch engagement with latch means of the module for preventing overstressing of the connector latches.

4. A tool according to claim 3 wherein each body leg has an additional tapered surface facing outwardly from the body toward the distal end of the leg and outwardly from said plane to permit portions of the body legs to be pressed against portions of the module adjacent respective opposite ends of the module to pry the module from the connector for separating the resiliently engaged module and connector contacts.

5. A tool according to claim 4 wherein the taper of said additional tapered surface portions is selected for rotating the module around a selected axis in separating resilient engagement of the module and connector contacts.

6. A tool according to claim 5 wherein the body comprises two relatively movable portions, and means detachably connect the two relatively movable portions to each other to provide the selected spacing between the legs for accommodating modules of selected different lengths between the legs.

7. A tool according to claim 6 having flexible fingers extending from respective opposite flat sides of the body at a location between the body legs for receiving the module between the fingers, the fingers being movable by a user of the tool to grasp the module therebetween for removal from the connector.

* * * * *